United States Patent [19]

Fray

[11] Patent Number: 4,904,356

[45] Date of Patent: Feb. 27, 1990

[54] ELECTRODE FOR ELECTROREFINING

[75] Inventor: Derek J. Fray, Trumpington, England

[73] Assignee: National Research Development Corporation, London, England

[21] Appl. No.: 348,104

[22] Filed: May 1, 1989

[30] Foreign Application Priority Data

Nov. 25, 1986 [GB] United Kingdom ..... 8628137
Feb. 18, 1987 [GB] United Kingdom ..... 8703698

[51] Int. Cl.[4] ..... C25C 3/00

[52] U.S. Cl. ..... 204/64 R; 204/244; 204/243 R; 204/280; 204/287; 204/294

[56] References Cited

U.S. PATENT DOCUMENTS 3,323,908 6/1967 Tezuka ..... 75/63
3,677,926 7/1972 Davis ..... 204/243 R
4,118,292 10/1978 Fray et al. ..... 204/67
4,214,956 7/1980 Bowman ..... 204/67
4,288,246 9/1981 Banski et al. ..... 75/68 R
4,518,475 5/1985 Sivilotti ..... 204/64 R
4,613,414 9/1986 Sivilotti et al. ..... 204/70
4,707,239 11/1987 Murphy et al. ..... 204/247

FOREIGN PATENT DOCUMENTS 0049600 4/1982 European Pat. Off. .
3126940 3/1983 Fed. Rep. of Germany .
1515216 9/1976 United Kingdom .

*Primary Examiner*—John F. Niebling
*Assistant Examiner*—Kathryn Gorgos
*Attorney, Agent, or Firm*—Cushman, Darby & Cushman

[57] ABSTRACT

A carbon block acts as a cell electrode. Channels are formed in its face which is to face the cell diaphragm. The channels provide an interconnected network including retention pools arranged to hold, release, break up and mix a liquid stream passing through them.

15 Claims, 1 Drawing Sheet

ELECTRODE FOR ELECTROREFINING

This is a continuation of application Ser. No. 125,284, filed Nov. 25, 1987 now abandoned.

This invention relates to an electrode for use in electro-refining of metals, to a cell including the electrode and to an electrorefining and an electrowinning method using the cell.

A known packed bed cell for electrorefining metals is described in UK Patent Specification 1515216, and comprises an anode compartment containing a bed of conductive particles, such as carbon or a refractory hard metal such as $TiB_2$, in a salt which is molten or in a conductive solution, means for passing a stream of molten metal or molten salt or salt in a conductive solution in to the bed, a diaphragm of which one side (at least in part) bounds the anode compartment, a cathode compartment containing a bed of conductive particles in a salt which is molten or in a conductive solution on the other side of the diaphragm which is pervious to the salt(s) but not to the molten metal. The cathode compartment may have means for passing a stream of molten metal through the bed. The anode compartment may have means for recirculating the liquid passed into and through it.

The diaphragm is saturated with the salt and, although preventing mixing of molten metal from opposite sides thereof, it is pervious to the salt and thus does allow metal ions to move through freely. The conductive particles may for example be granules of carbon or of titanium diboride; even metal particles can be used for unattacked by the salt(s) or the metal being refined and its contaminant(s). The salt is preferably a halide, (usually these are cheaper), e.g. zinc chloride or aluminium chloride, either possibly including as impurities or diluents up to 95% of sodium chloride and/or potassium chloride and/or lithium chloride. The salt advantageously is or includes a salt of the metal to be refined. Although the salt at the anode most conveniently has the same composition as that at the cathode, this is not essential. The metal may be zinc including as impurities for example aluminium, lead, cadmium, copper, tin and/or iron. Such a combination of impurities may arise when recovering zinc from scrap diecastings. The metal may alternatively be aluminium, which may include as impurities such metals as zinc, tin, lead, copper and/or gold.

According to the present invention, an electrode for use in electrowinning or electrorefining of metals comprises an electronically conductive block in one face of which are formed channels of varying crosssection and direction. The channels may interconnect, i.e. may form a network. The block may be of any inert electronically conducting material, such as carbon.

The invention extends to a sub-assembly comprising the electrode with a diaphragm impervious to molten metal but pervious to metal ions placed facing said one face with an electrically insulating sheet or sheets optionally interposed and shaped to expose the channels to the diaphragm. The invention extends to a cell comprising the sub-assembly set forth above with a second electrode as set forth above sandwiching the diaphragm.

An alternative sub-assembly comprises the electrode with such an insulating sheet and/or the electrode mounted in a slot-in frame adapted to receive electrodes, sheets if any and diaphragms. The invention extends to a cell comprising the sub-assembly fitted with a second electrode as set forth above and with a diaphragm interposed between the electrodes.

In both cases the second electrode's channels may be substantially a mirror-image of, and in registry with, the first electrode, or the second electrode could have a planar surface facing the diaphragm, in which case some second-electrode/diaphragm separation is advisable, so that any material electrodeposited on the second electrode will not pierce the diaphragm.

The diaphragm may be a fibrous ceramic fabric impervious to molten metal. It should be mounted either touching the electrode or may be spaced slightly from the electrode face; in the latter case, molten metal will not enter the space if it is kept small enough for surface tension to restrain it. As the diaphragm cannot, as a practical matter, be relied upon to remain so taut that this spacing is always accurately assured, the face of the electrode may be insulated and hence the diaphragm protected by a mica sheet cut out to fit the face of the electrode, i.e. reveal its channels.

Preferably, in the cell according to the invention, the electrode in its use orientation has channels which are so formed as to provide a continuous route or routes for molten metal overall downwardly across said face, said route(s) being such as to promote both mixing and break-up of the molten metal stream. Thus, retention pools may be provided, with exits constricted to break up the flow of metal and leading to further like retention pools, optionally via generally horizontal distribution-and-mixing channels interconnecting routes down the face.

A plurality of cells as set forth above may be arranged contiguously, that is with the anode of a first cell serving also as the cathode of a contiguous second cell, with the anode of the second cell optionally serving as the cathode of a contiguous third cell, and so no as often as desired.

The invention extends to a method of refining using the cell set forth above, comprising passing a stream of molten metal through the channels of the first electrode in the presence of a molten salt of salt in a conductive solution saturating the diaphragm, and making the first electrode anodic with respect to the second electrode, and recovering the refined metal(s) which appear in the cathode channels. In place of the molten metal, a salt of the metal to be recovered may be used, so that the cell is effecting a primary metal-electrowinning from salt.

The invention will now be described by way of example with reference to the accompanying drawings, in which.

Figure 1:
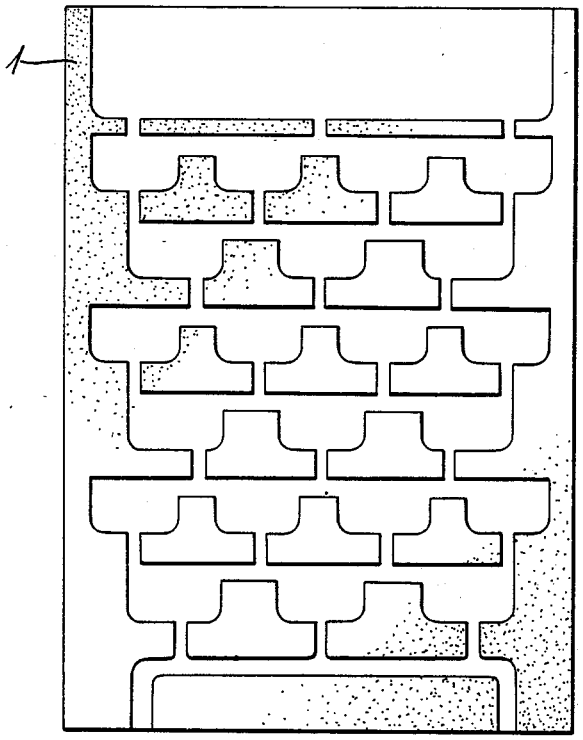
FIG. 1 is an end elevation of an electrode according to the invention.

Turning to FIG. 1, a cuboidal graphite block 150 mm high×100 mm wide×30 mm thick has a network of channels machined out to a depth of 3 mm on one face. Alternatively, the channels could have been formed by pressing carbon in a shaped and pre-profiled mould to make the channelled electrode, or otherwise. The channels consist of narrow straight elements running between wider retention pools. The channels are at 20 mm centers, the horizontal straight sections being about 5 mm wide, the vertical sections being narrower and the pools being 15 mm across. The arrangement is intended to cause the metal stream to change direction many times and to be well stirred and mixed while also ensuring its retention in pools for reasonable periods. It is possible for the electrode to be grooved such that some 80–90% of its surface area is molten metal. The arrangement of grooves further seeks to restrain the downward flow of molten metal in such a way that the body of liquid is broken up such as to impose a hydrostatic head nowhere exceeding about 1 cm. (If the block 1 had a plain uniform serpentine channel conveying a continuous body of molten metal, the hydrostatic head of metal imposed on the base of any adjoining diaphragm would be equivalent to the full 150 mm.)

Figure 2:
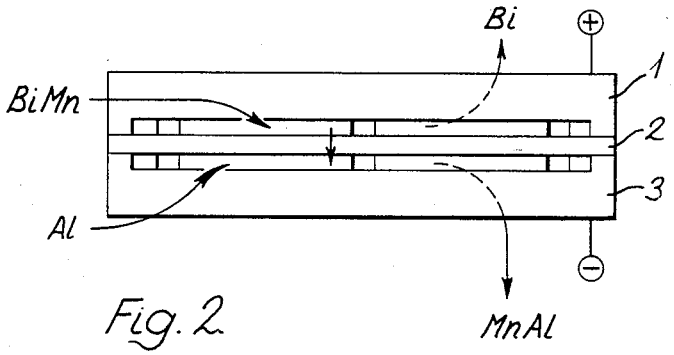
FIG. 2 is a schematic plan of a cell according to the invention used in a possible refining scheme.

In FIG. 2, as seen in plan, the block of FIG. 1 acts as an anode 1. A mirror-image block of graphite acting as a cathode 3 is mounted in registry with the anode, the two electrodes sandwiching a diaphragm 2. The elements 1, 2 and 3 are mounted with slight clearance (too small to be illustrated) into a prefabricated slot-in frame (not shown). The diaghragm 2 is a fibrous ceramic fabric consisting of aluminosilicate or silica fibers felted or spun and woven to form a material e.g. Fiberfrax PH (Carborundum Co.) or Triton Kaowool (available from Morganite) in half-inch or one-inch thickness, or Refrasil (Chemical & Insulating Co. of Darlingtonn (Darchem Group)) one-tenth of an inch thick. An alternative diaphragm material is carbon felt, which is more resistant to puncturing by dendrites, but to avoid short-circuiting care must be taken to keep it from actually touching the electrodes (for example by using spacers). The diaphragm is normally an insulator but when saturated with electrolyte (as will be described) can transport current in the form of ions.

In use, in one application, bismuth-manganese alloy is to be separated, the manganese being recovered in the form of aluminium-manganese master alloy. The molten bismuth-manganese alloy is supplied to the top of the anode 1 and is allowed to trickel down the channels. The clearance between the anode 1 and the diaphragm 2 is sufficiently fine to restrict the metal to the channels. The diaphragm 2 is impervious to the molten alloy, but is saturated with molten sodium chloride - potassium chloride -manganous chloride electrolyte. The labyrinthinen configuration of the channels allows the metal to flow through the pools of alloy and molten salt held in the electrode surface.

The cathode 3 contains molten electrolyte including sodium chloride in its channels and molten aluminium is trickled through its channels. The electrolytic action of anode and cathode selectively oxidises the manganese contained in the BiMn alloy at the anode, and this manganese is ionically transported across the diaphragm 2 to the cathode 3, where it is reduced to elemental manganese, which is collected by dissolution in the aluminium as it trickles down the cathode channels. The aluminium supplied directly to the cathode assists physically the collection of the cathodically deposited manganese, whose melting point without the presence of the aluminium would be impracticably high.

The shallowness of the channels and their labyrinthine course have the advantage that no large head of liquid metal builds up anywhere to stress the diaphragm 2. The diaphragm, traditionally a troublesome component of any cell, should, therefore, have a better chance of a long reliable service life.

The short anode-cathode distance keeps cell resistive losses to a minimum and also allows closer control over the actual voltage applied, local variations due to the thickness of the cell being kept relatively minor by the geometry and construction (especially the narrow anode/cathode spacing) of the cell according to the invention.

This close control over the voltage allows a user to differentiate between say elements of close electrode potentials such as tin and lead ($Sn^2/Sn^o = -1.04V$; $Pb^2/Pb^o = -1.11V$); thus it might be possible to select an applied voltage which would transport lead across the diaphragm while leaving the tin behind. The individual constituents of alloys such as solder could thus be recovered separately whereas this would be impossible in a conventional cell, where the large cathode/anode spacings necessary to prevent back-reaction of products would introduce the very voltage irregularities which would swamp any distinction between tin and lead.

At the cathode, as a further application, other metals than manganese such as titanium can be recovered from molten solution in bismuth, or metals such as manganese from molten solution in antimony.

The cell can also be used to deposit elemental metal from an aqueous or molten salt running through the channels of the anode 1 onto the cathode 3.

In the case of refining a zinc-lead alloy in eutectic molten chloride in a cell as set forth above, a current of 6 $kAm^{-2}$ was observed at $\frac{1}{4}V$, the cathode product containing two to three orders of magnitude less lead than the anode feedstock.

A plurality of cells as set forth above may be arranged contiguously, that is with the anode of a first cell serving also as the cathode of a contiguous second cell, with the anode of the second cell optionally serving as the cathode of a contiguous third cell, and so on as often as desired.

I claim:

1. An electrode for use in electrowinning or electrorefining metals, comprising an electronically conductive block having an upright, generally planar face, the face having formed therein a network of interconnecting channels, the channels being disposed to provide a plurality of continuous routes for molten metal to flow overall downwardly across said face, said routes comprising a plurality of downward channels fluidly coupled to a single horizontal distribution-and-mixing channel fluidly coupled to at least one further downward channel so that the routes are interconnected by the horizontal channel, thereby promoting mixing and break-up of liquid streams flowing therethrough.

2. An electrode according to claim 1, wherein the routes include retention pools with exits constricted to break up the flow of a liquid and leading to further like retention pools.

3. An electrode according to claim 2, wherein the retention pools are interconnected via the horizontal distribution-and-mixing channel itself interconnecting downwards routes.

4. An electrode according to claim 1, wherein the block is of carbon.

5. A sub-assembly comprising an electrode according to claim 1, and a diaphragm impervious to molten metal but pervious to metal ions, the diaphragm being placed facing said planar face of said block.

6. A sub-assembly according to claim 5, further comprising a second electrode sandwiching the diaphragm.

7. A sub-assembly according to claim 5, further comprising at least one electrically insulating sheet interposed between the diaphragm and the electrode, and shaped to expose the channels to the diaphragm.

8. A sub-assembly according to claim 7, wherein each of the sheets is of mica.

9. A sub-assembly according to claim 5, comprising the electrode mounted in slot-in frame adapted to receive at least one of the electrode, diaphragms and sheets.

10. A cell comprising a sub-assembly according to claim 5 fitted at least with two electrodes and an interposed diaphragm.

11. A cell according to claim 10, wherein the electrodes' channels are substantially a mirror-image of, and in registry with, each other.

12. A plurality of cells according to claim 10, wherein the cells are arranged contiguously, with an anode of a first cell serving as a cathode of a continguous second cell.

13. A method of electrowinning a metal, using a cell according to claim 10, comprising passing a stream of a solution or melt of a salt of the molten metal through the channels of a first electrode in a molten salt or a salt in a conductibe solution saturating the diaphragm, and making the first electrode anodic with respect to a second electrode, and recovering a refined metal which appears in cathode channels.

14. A method of refining, using a cell according to claim 10, comprising passing a stream of molten metal through the channels of a first electrode in a molten salt or a salt in a conductive solution saturating the diaphragm, and making the first electrode anodic with respect to a second electrode, and recovering a refined metal which appears in cathode channels.

15. A sub-assembly comprising an electrode according to claim 1 and at least one electrically insulating sheet on said planar face but shaped to expose the channels.

* * * * *